US006109823A

United States Patent [19]

Halferty et al.

[11] Patent Number: 6,109,823

[45] Date of Patent: Aug. 29, 2000

[54] METHOD OF CONVERTING EXISTING TANK ACCESS WAYS

[75] Inventors: Daniel J. Halferty, Baton Rouge, La.; Mark D. Robinson, Black River, N.Y.

[73] Assignee: Stebbins Engineering & Manufacturing Co., Watertown, N.Y.

[21] Appl. No.: 09/196,917

[22] Filed: Nov. 20, 1998

[51] Int. Cl.[7] ..... E02D 29/14

[52] U.S. Cl. ..... 404/25; 220/323; 292/256.5

[58] Field of Search ..... 220/323, 325, 220/315, 318, 825, 833; 292/256.5, 142, 256.71, 256.75; 404/25

[56] References Cited

U.S. PATENT DOCUMENTS

| | | |
|---|---|---|
| 2,551,750 | 5/1951 | Liskey, Jr. . |
| 2,744,654 | 5/1956 | Swerdlow . |
| 2,900,104 | 8/1959 | Schmidt, Jr. . |
| 3,045,861 | 7/1962 | Dieter et al. . |
| 3,077,360 | 2/1963 | Israel . |
| 3,721,363 | 3/1973 | Bressler et al. . |
| 3,744,670 | 7/1973 | De Frees . |
| 4,393,756 | 7/1983 | van der Schoot . |
| 4,566,375 | 1/1986 | van der Schoot . |
| 5,625,655 | 4/1997 | McDonald et al. . |
| 5,660,295 | 8/1997 | Hroma et al. . |

OTHER PUBLICATIONS

Chemipulp Process, Inc. "Manway Fabrication Details" Jun. 29, 1998.

*Primary Examiner*—Eileen D. Lillis
*Assistant Examiner*—Raymond W Addie
*Attorney, Agent, or Firm*—Wall Marjama Bilinski & Burr

[57] ABSTRACT

A method of replacing an outwardly opening manhole cover that provides access to the interior of a tank or the like with an inwardly opening cover that includes the steps of removing the outwardly opening cover from the bolting flange of a tank installed manway and attaching a mounting flange to the manway bolting flange. A pair of hinges are connected to the mounting flange and an inwardly opening cover assembly is rotatably mounted on the hinges. The cover of the assembly is arranged to close and seal against either the mounting flange or the inner rim of the existing manway.

23 Claims, 4 Drawing Sheets

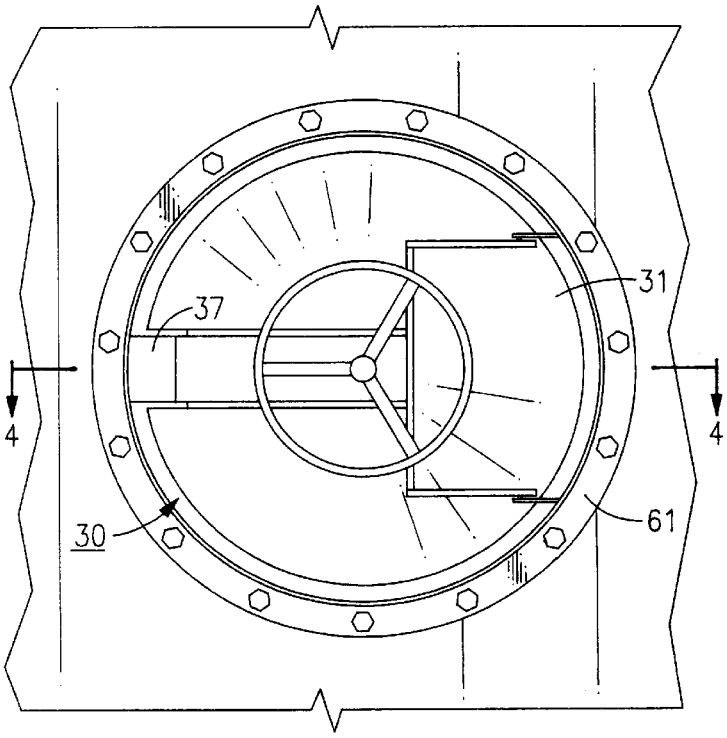
FIG.3
FIG.7
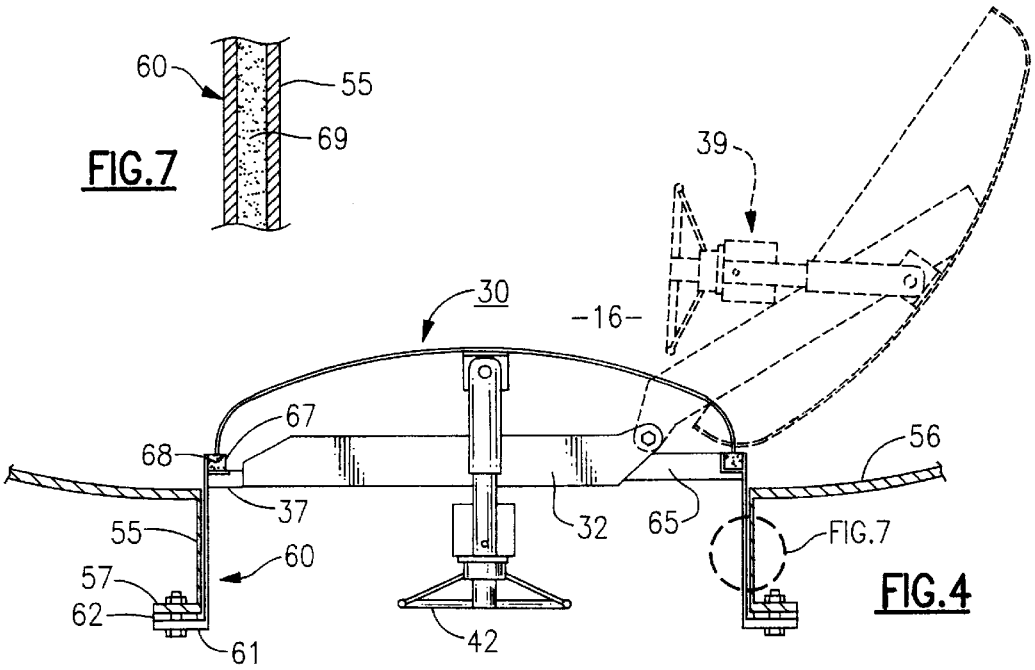
FIG.4

METHOD OF CONVERTING EXISTING TANK ACCESS WAYS

BACKGROUND OF THE INVENTION

This invention relates to an access manhole that is mounted in a storage or process tank or the like and, in particular, to a method of replacing an outwardly opening manhole cover with an inwardly opening manhole cover.

Many storage or process tanks and, in particular, older tanks, are equipped with manholes that include covers that open outwardly with regard to the tank. Typically, the cover is bolted to a flange that encircles the outside of a cylindrical manway. The term manway, as herein used, refers to a tubular member that is welded or otherwise joined to the tank to provide access into the tank. In the event the tank is pressurized or contains material that exerts an outwardly directed force against the cover, the bolts holding the cover in place must be strong enough to prevent unwanted opening of the cover. By replacing the outwardly opening cover with one that opens inwardly, any material forces that are exerted against the cover will help to hold the cover closed and will prevent material stored in the tank from collecting in the manway. Material that is collected in the manway produces unwanted spillage when the outwardly opening cover is removed and under certain conditions, can be hazardous. In addition, in process vessels, material which collects in the manway does not circulate freely within the vessel and thus, is typically over processed.

Replacing an outwardly opening manhole within a storage tank with a more preferred inwardly opening cover also has heretofore presented certain structural difficulties where the existing manway is removed from the tank and replaced with an entirely new manhole unit. Complete removal of the existing manhole can produce structural damage to the tank shell in and about the manway opening that oftentimes requires extensive repair to the tank. Furthermore, retrofitting a new manway to the repaired opening is sometimes difficult and can result in damage to existing tank coatings, linings or insulation.

DESCRIPTION OF THE RELATED ART

Turning initially to FIGS. 1 and 1A, there is shown a typical outwardly opening manhole which is constructed in accordance with the American Petroleum Institute Standard 650 welded steel tanks for oil storage. The manhole 10 includes a manway 12 that surrounds an opening 13 formed in the tank shell 15 that communicates with the interior 16 of the tank. The manway contains a cylindrical body section 17 having an inner flange 18 that is welded to the tank shell and an outer bolting flange 19. A cover 20 is secured to the outer flange by a number of bolts 22. A gasket 24 is generally mounted between the outer flange and the cover to prevent leakage from the tank to the surrounding environment. Although the manway is shown oriented vertically, the actual orientation could vary anywhere from vertical upward opening to horizontal to vertical downward opening.

As noted above, the outwardly opening manhole has certain disadvantages and it is oftentimes desirable to replace the outwardly opening manholes with ones that open inwardly. The conversion, however, can cause damage to a steel tank or weaken the tank, particularly where the existing manway is cut away from the tank shell and replaced with a completely new unit. In the case of a tank constructed of refractory bricks or the like, damage can also be extensive and the amount of repairs required to place the tank back in service rather costly. As will be described in detail below, the present invention relates to a method of converting an existing outwardly opening manhole with one that opens inwardly so that it causes little or no damage to either a steel or refractory tank. The present method of converting a tank is also more cost effective than those previously employed in the industry and results in a more secure and tighter fitting installation.

SUMMARY OF THE INVENTION

It is therefore an object of the present invention to provide an improved method of converting existing manholes in storage tanks or the like so that the cover of the tank opens inwardly rather than outwardly.

A further object of the present invention is to replace an existing manhole in a tank with a minimum of damage being done to the tank structure.

A still further object of the present invention is to reduce the amount of time required to replace an outwardly opening manhole in a tank with one having an inwardly opening cover.

Another object of the present invention is to provide an existing outward opening manhole with an inwardly opening cover that is capable of being positively sealed without undue retrofitting of the tank.

These and other objects of the present invention are attained by converting an existing manhole in a tank which has an outwardly opening cover mounted upon a bolting flange with a cover unit having an inwardly opening manhole. The conversion is accomplished by removing the cover form the bolting flange of the existing manway. A pair of spaced apart hinges for an inwardly opening cover are joined to a mounting flange and the mounting flange is attached to the existing bolting flange. An inwardly opening cover unit is rotatably mounted upon the hinges so that it closes against either the mounting flange or the rim of the manway.

BRIEF DESCRIPTION OF THE DRAWINGS

For a better understanding of these and other objects of the present invention, reference will be made to the following detailed description of the invention which is to be read in conjunction with the accompanying drawings, wherein:

FIG. 3 is a partial bottom view showing a further embodiment of the present invention;

FIG. 4 is a section taken along lines 4—4 in FIG. 3;

FIG. 7 is an enlarged partial view in section showing grouting packed in the space between the original manway and the insert.

DESCRIPTION OF THE INVENTION

Figure 1:
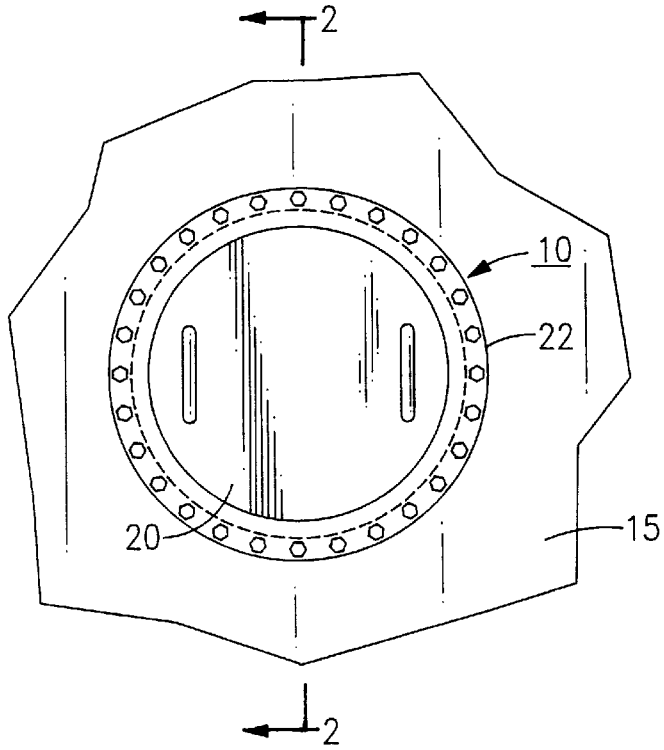
FIG.1 Prior Art
FIG. 1 is a partial top plan view of a prior art outwardly opening manhole cover that is mounted upon a storage tank.
Figure 1A:
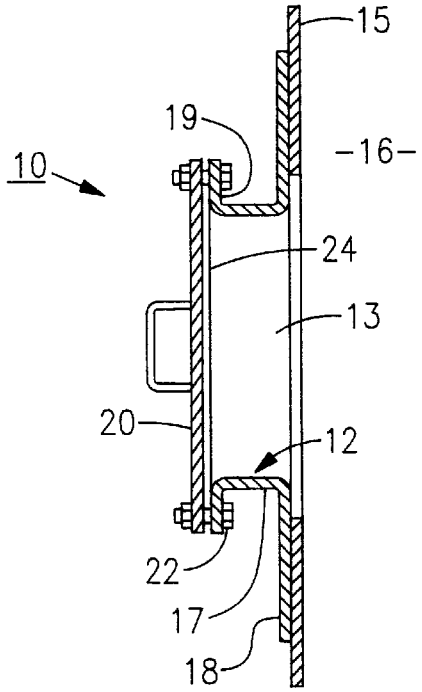
FIG.1A Prior Art
FIG. 1A is a section taken along lines 2—2 in FIG. 1.
Figure 2:
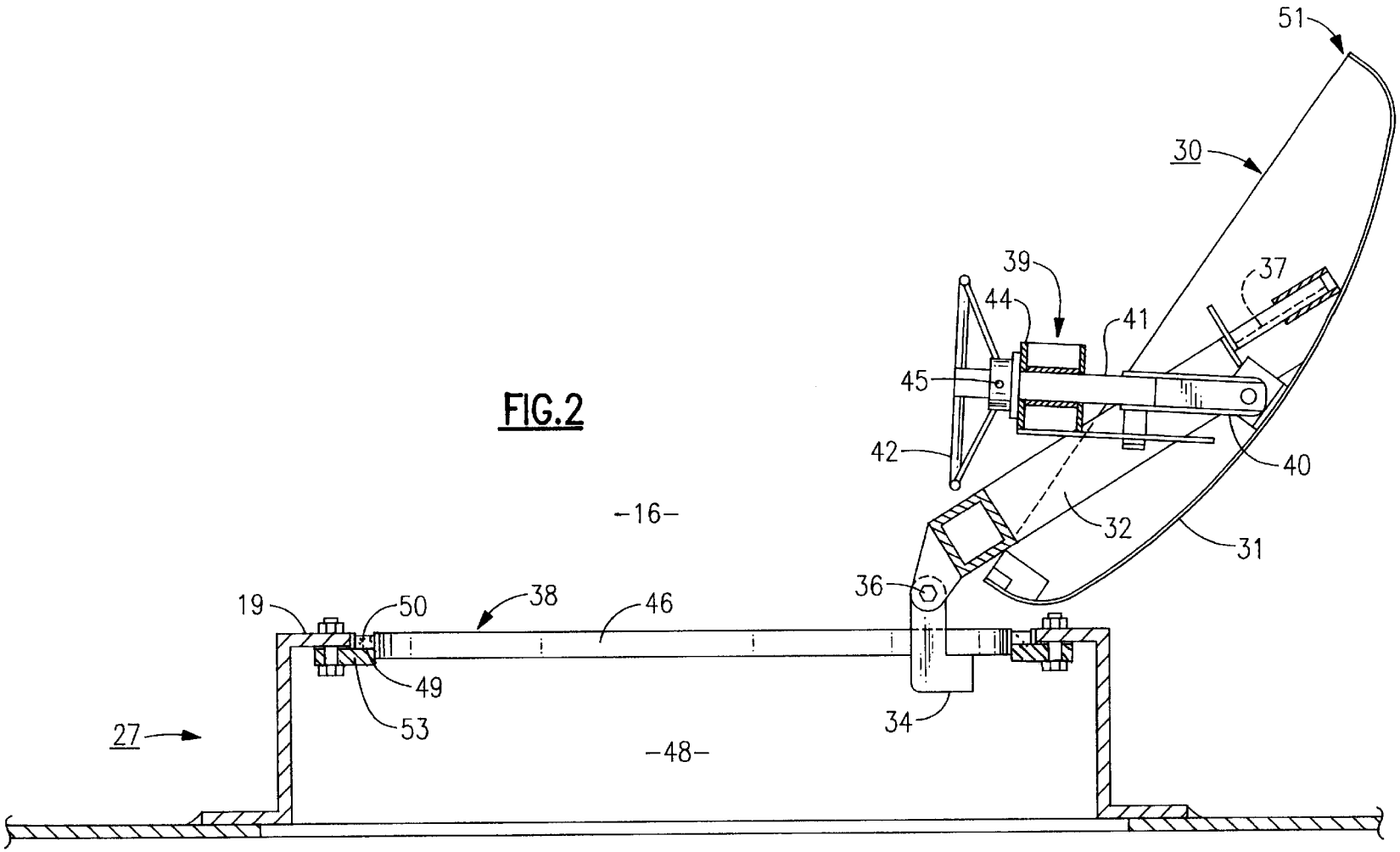
FIG. 2 is a partial side elevation in section showing an existing outwardly opening manhole that has been modified to accept an inwardly opening cover.

Turning now to FIG. 2 there is illustrated an existing manhole 27 that is installed in a tank 28 which is similar in construction to that described in the American Petroleum Industry Standard 650. The manhole has been retrofitted to accept an inwardly opening cover assembly generally referenced 30. The cover assembly itself is well known and widely used throughout the industry and includes a dome shaped cover 31 that is pivotally mounted upon a beam 32 so that the cover can freely turn about the beam. A pair of spaced apart hinges generally referenced 34 are secured to the back of the beam and, as will be described below, the entire cover assembly is arranged to swing inwardly about the hinge pins 36. A bolt 37 is slidably contained at the distal end of the beam which, as will be explained below, is capable of engaging a mounting flange 38 associated with the manway to secure the cover in a closed position.

A locking mechanism 39 is also operatively associated with the beam and the cover which is adapted to pull the cover downwardly toward the manhole during closure. The locking mechanism includes a tubular member 40 that is pivotally attached at one end to the cover. The tube contains internal threads which mate with a thread rod 41. A hand wheel 42 is pinned to the distal end of the threaded rod to facilitate turning of the rod within the tubular member. A bracket 44 is pivotally supported in the beam and is pinned at 45 to the threaded rod. As can be seen when the beam is secured to the manway by the bolt, the cover can be drawn down by turning the hand wheel.

To convert the existing manway, the outwardly opening cover is removed from the bolting flange 19 of the manway and is replaced by a mounting flange 38. The mounting flange can be welded to the existing bolting flange or bolted thereto using the existing bolting hole arrangement. The mounting flange contains a central opening 46 therein through which access to the tank can be had. The opening in the mounting flange is slightly less in diameter than that of the opening 48 in the existing manway and a peripheral groove 49 is formed in the top surface of mounting flange about the opening 48. The groove is positioned in the mounting flange on the inside of the original manway opening. A seal 50 is mounted within the groove that contacts the rim 51 of the cover when it is closed against the mounting flange. A gasket seal 53 that is capable of functioning as a seal is mounted between the bolting flange 19 and the mounting flange 38 to further provide for a leak-proof closure about the manhole.

To close the manhole, the cover assembly is rotated downwardly about the binges so that the rim of the cover rests against the seal 50. The bolt 37 is then moved forward so that it closes under the mounting flange 38. The hand-wheel 42 is now turned to draw the rim of the cover 51 down into tight sealing engagement against the seal 50. To open the cover, the above described procedure is reversed. Because of the multiple hinged arrangement of the cover, the cover can be moved back and to one side of the access opening during the opening procedure to provide clear access to the tank through the opening in the mounting flange. As can be seen when the cover is closed and locked in place, material stored in the tank cannot collect in the manway. In addition, any internal pressure that is exerted upon the cover will help to retain the cover in the closed position.

With further reference to FIGS. 3 and 4, there is illustrated another embodiment of the present invention in which the existing manway 55 protrudes outwardly some distance from the shell 56 of the tank. The outer end of the manway terminates in a bolting flange 57 to which an existing outwardly opening cover unit 20, similar to that described above, is bolted. The cover, during conversion, is removed and a smaller diameter secondary manway, which will herein be referred to as insert 60, is inserted into the existing manway. The insert has an outer mounting flange 61 that mates with the bolting flange 57 of the existing manway and is secured thereto by welding, bolting or the like. A gasket 62 is mounted between the two flanges to provide a leak proof joint therebetween.

The axial length of the insert is greater than that of the original manway so that the distal end of the insert extends into the interior of the tank. An annular ring 65 surrounds the distal end of the insert upon which an inwardly opening cover assembly 35, as described above, is pivotally mounted. Although not shown, the bolt of the cover assembly is adapted to pass under the annular ring to secure the cover to the insert at closure. A peripheral groove 67 is formed in the top surface of the mounting flange. A seal 68 is mounted in the groove against which the cover closes. Here again, the hand wheel of the cover assembly is used to draw the cover down into sealing engagement with the seal to provide a leak-tight joint therebetween. Grouting 69 can also be placed within the gap between the existing manway and the insert to further seal the manhole in assembly.

Figure 5:
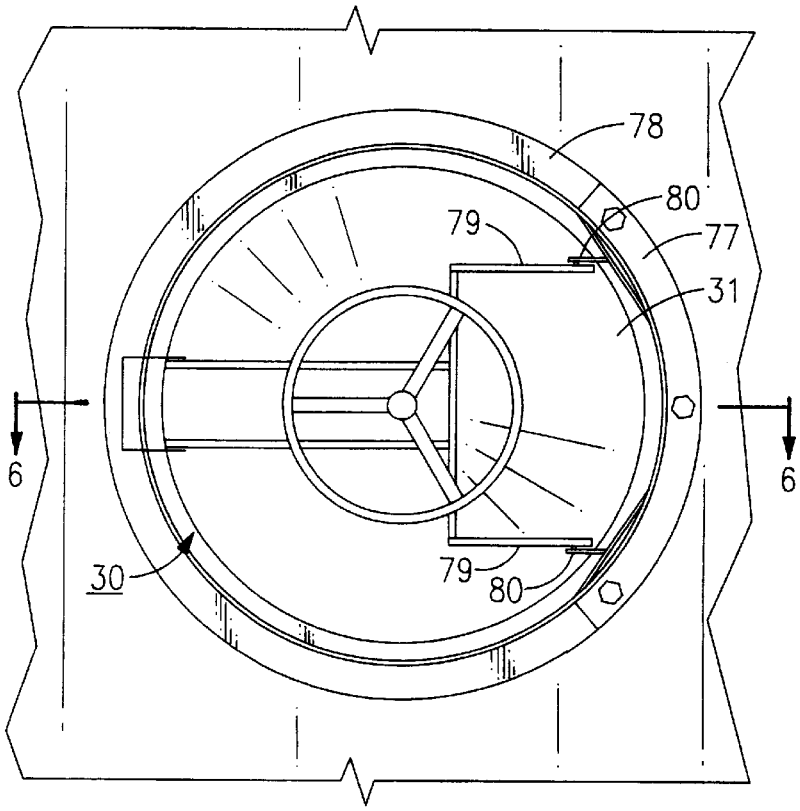
FIG. 5 is a partial bottom view of a still further embodiment of the present invention.
Figure 6:
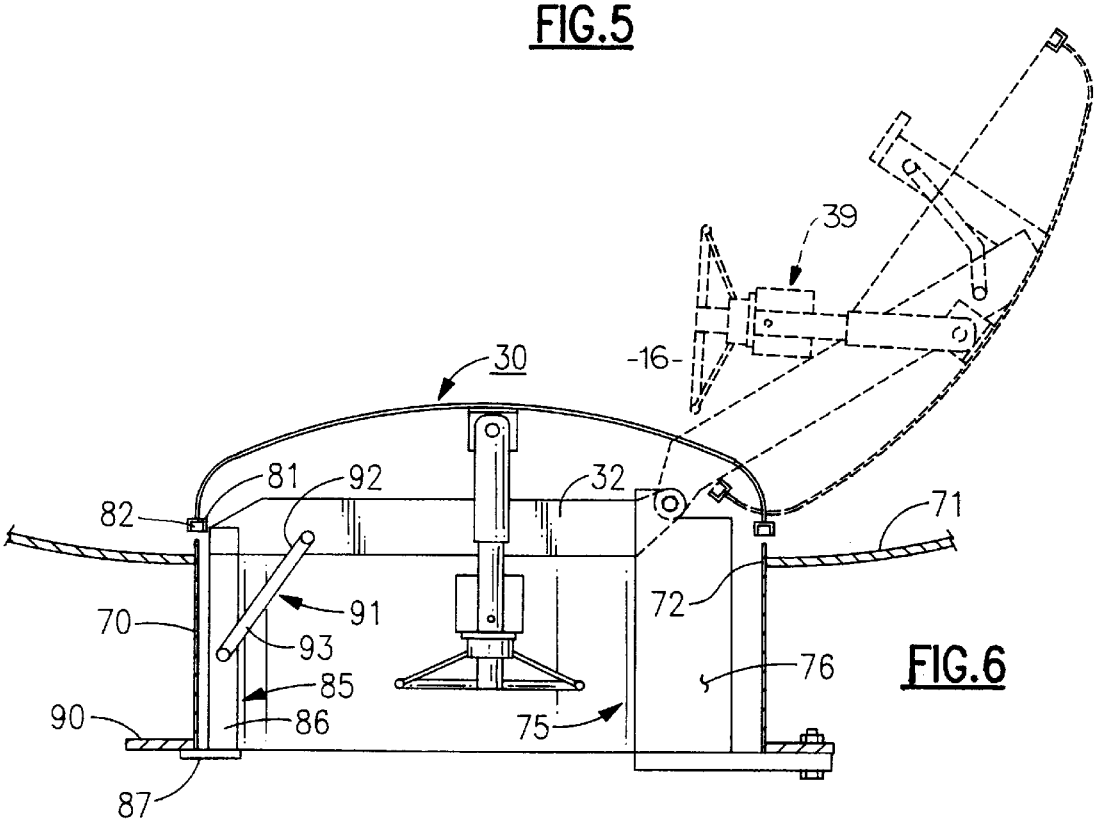
FIG. 6 is a section taken along lines 6—6 in FIG. 5.

A still further embodiment of the invention is illustrated in FIGS. 5 and 6. Here again, the existing manway 70 is rather elongated and passes through the shell 71 of the tank to provide an annular lip about the upper periphery of the manway. The original outwardly opening cover is removed from the outside bolting flange of the manway and a hinge assembly, generally referenced 75 is passed into the manway as shown. The hinge assembly includes an arcuate shaped foot 77 that is welded or bolted onto the existing bolting flange 78. A pair of spaced apart elongated stanchions 76 are secured to the foot and pass upwardly inside the existing manway in assembly. A pair of hinges 80 are mounted upon the distal end of the stanchions upon which an inwardly opening cover assembly 35, as described above is pivotally mounted. The cover is provided with a peripheral housing 81 that extends about the entire rim of the cover and contains a seal 82. In assembly, the seal is arranged to close against the upper rim of the existing manway to provide a leak-proof closure for the cover when the cover is secured and locked in place.

A latching mechanism 85 is provided to secure the cover in a closed position prior to locking it in place using the handwheel. The latching mechanism includes an elongated lever arm 86 that is pivotally mounted on the front of the cover beam. The lever arm terminates in a hook like appendage 87 that is arranged to pass under the bolting flange 90 of the existing manway to secure the cover in place at closure. A latch support brace 91 is provided to hold the lever arm in the latching position beneath the bolting flange. The brace is a two bar linkage comprising an upper link 92 pivotally mounted on the cover beam 32 and a lower link 93 that is pivotally mounted on the lever arm 86. The two links are rotatably joined at their distal ends so that the link can be brought into axial alignment at closure to prevent the latch from inadvertently becoming released after the cover has been secured in place.

Although the seal 82 is shown mounted in a peripheral housing 81, other suitable sealing arrangements may be similarly employed without departing from the teachings of the present invention. A further sealing arrangement is illustrated in FIG. 7. In this arrangement, the seal 100 is an annular shaped member that is oval in cross section and which contains a deep groove 101 that passes downwardly through the top of the seal. The seal is fabricated from a resilient rubber-like material. The diameter of the groove is coextensive with that of the cover rim 102 and the width of the groove is slightly less than the thickness of the cover. A tight interference fit is thus provided between the groove and rim so that the seal can be press fitted onto the cover. The seal thickness is sufficient so that a secure positive seal is formed against the upper rim of the existing manway at closure. Other suitable sealing arrangements may also be employed to establish a positive leak-proof joint between the cover and the cover receiving surface which can be located either on the mounting flange or the manway sleeve.

While this invention has been explained with reference to the structure disclosed herein, it is not confined to the details set forth and this invention is intended to cover any modifications and changes as may come within the scope of the following claims:

What is claimed is:

1. A method of replacing an outwardly opening manhole cover that is mounted upon a bolting flange of a tank-installed manway with an inwardly opening cover that includes the steps of:

removing an outwardly opening manhole cover from a bolting flange of tank-installed manway that contains a first opening for providing access to the interior of a tank, attaching a mounting flange to the bolting flange of the existing manway, connecting a pair of spaced apart hinges to the mounting flange, and rotatably mounting a cover assembly upon said hinges said cover assembly containing a cover that opens from a closed position inwardly to an open position.

2. The method of claim 1 that includes the further step of forming a second access opening in said mounting flange that is smaller than the first manway opening to provide a cover receiving surface in said mounting flange.

3. The method of claim 2 that further includes the step of providing a sealing means containing a seal for creating a leak proof joint between said inwardly opening cover and said cover receiving surface when the cover is in a closed position.

4. The method of claim 3 wherein said cover is arranged to close against a top surface of said mounting flange.

5. The method of claim 4 that includes the further steps of forming a groove in the top surface of said mounting flange that surrounds the access opening in said mounting flange and mounting the seal within said groove.

6. The method of claim 1 that further includes the step of joining an insert to said mounting flange and passing the insert through said first manway opening and attaching the hinges to the said insert so that the inwardly opening cover closes against the upper rim of said insert.

7. The method of claim 6 wherein a said seal is mounted upon said cover.

8. The method of claim 6 wherein said seal is mounted upon said insert.

9. The method of claim 1 that includes the further step of mounting a gasket between the bolting flange and the mounting flange.

10. The method of claim 1 that includes the further step of bolting the mounting flange to the bolting flange.

11. The method of claim 1 that includes the further step of welding the mounting flange to the bolting flange.

12. The method of claim 6 that includes the step of providing a gap between the insert and the manway and filling the gap with a grouting material.

13. A method of replacing an outwardly opening manhole cover that is mounted upon a bolting flange of a tank-installed manway with an inwardly opening cover that includes the step of:

removing an outwardly opening cover from a bolting flange of a tank-installed manway, said manway having a first opening passing therethrough between one end containing said flange and another end containing an annular rim that provides access to the interior of said tank, said manway passing through the tank wall so that said annular rim is located inside said tank;

providing a mounting unit containing a pair of hinges mounted upon stanchions so that the mounting unit is insertable into the existing manway, joining the mounting unit to a mounting flange and attaching the mounting flange to the bolting flange so that the hinges are at a predetermined location with regard to the rim of said existing manway, and rotatably mounting a cover assembly upon said hinges, said cover assembly containing a cover that opens inwardly from a closed position against said rim to an open position.

14. The method of claim 13 that includes the further steps of attaching bolt to said cover assembly for engaging the manway to secure the cover assembly to the rim of the manway when the cover is closed against the rim.

15. The method of claim 14 that includes the further step of sealing the cover against the rim of the existing manway.

16. The method of claim 15 that includes the further step of mounting a cover seal upon the cover.

17. The method of claim 15 that includes the further step of mounting a cover seal upon the existing manway.

18. A method of replacing an outwardly opening manhole cover that is mounted in a tank with an inwardly opening manhole cover, said outwardly opening manhole cover being mounted upon an elongated manway attached to the tank, an annular bolting flange mounted upon one end of the manway and a cover bolted to the outside surface of the bolting flange, said method including the steps of:

removing the outwardly opening cover from the bolting flange of the manway of the tank, passing an insert having an annular mounting flange at one end surrounding its outer periphery into said manway so that the mounting flange is juxtaposed with the bolting flange, said insert having an axial length that is greater than that of the manway so that a rim at the other end of said insert extends into the tank, joining the mounting flange to the bolting flange, and hingedly mounting a cover assembly to said insert, said cover assembly containing a cover that opens inwardly from a closed position against said rim to an open position inside said tank.

19. The method of claim 18 that includes the further step of placing a seal between the rim and the inwardly opening cover to provide a leak-proof joint therebetween when the inwardly opening cover is closed against said rim.

20. The method of claim 19 that includes the further step of securing the seal to the cover.

21. The method of claim 19 that includes the further step of securing the seal to the insert.

22. The method of claim 18 that includes the further steps of providing a gap between the manway and the insert and filling the gap between the manway and the sleeve and filling the gap with a grouting material.

23. The method of claim 18 that includes the further step of mounting a gasket between the bolting flange and the mounting flange.

* * * * *

UNITED STATES PATENT AND TRADEMARK OFFICE

CERTIFICATE OF CORRECTION

PATENT NO. : 6,109,823

DATED : August 20, 2000

INVENTOR(S) : Halferty et al.

It is certified that error appears in the above-identified patent and that said Letters Patent is hereby corrected as shown below:

Claims 22, Column 6, Line 60, please delete the word "sleeve" and replace the favor of --insert--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*